US006269880B1

(12) United States Patent
Landry

(10) Patent No.: US 6,269,880 B1
(45) Date of Patent: Aug. 7, 2001

(54) SYSTEM FOR REMOVING SOLIDS FROM A WELL BORE

(76) Inventor: Ronald J. Landry, 5513 Smith Rd., New Iberia, LA (US) 70560

( * ) Notice: Subject to any disclaimer, the term of this patent is extended or adjusted under 35 U.S.C. 154(b) by 0 days.

(21) Appl. No.: 09/492,628

(22) Filed: Jan. 27, 2000

(51) Int. Cl.[7] ..... E21B 43/34
(52) U.S. Cl. ..... 166/265; 166/105.5
(58) Field of Search ..... 166/250.01, 265, 166/267, 369, 105.1, 105.5

(56) References Cited

U.S. PATENT DOCUMENTS

| | | | | |
|---|---|---|---|---|
| 4,428,839 | | 1/1984 | Davies et al. . | |
| 4,454,914 | * | 6/1984 | Watanabe | 166/266 X |
| 4,617,031 | | 10/1986 | Suh et al. . | |
| 4,737,168 | | 4/1988 | Heath . | |
| 4,948,393 | | 8/1990 | Hodson et al. . | |
| 5,431,228 | * | 7/1995 | Weingarten et al. | 166/357 |
| 5,827,357 | | 10/1998 | Farion . | |
| 6,026,901 | * | 2/2000 | Brady et al. | 166/265 |
| 6,112,814 | * | 9/2000 | Chan et al. | 166/304 |

* cited by examiner

*Primary Examiner*—Frank Tsay
(74) *Attorney, Agent, or Firm*—Domingue & Waddell, PLC

(57) ABSTRACT

A system for removing solids from a well bore and reclaiming the well bore fluid. A work string is disposed within the well bore. The system includes a gas separator, connected to a return line from the well bore, for separating the gas component from the well bore fluid, and wherein the gas separator has a first outlet for exiting the gas component and a second outlet for exiting the well bore stream. Also included is a solids separator, connected to the second outlet, for separating the remainder of the well bore fluid into a first stream containing the solids and a second stream containing the well bore fluid. The solids separator may be located longitudinally below the gas separator so that a hydrostatic head pressure aids in feeding the well bore fluid to the solids separator. The system further includes a cuttings box connected to the solids separator, with the cuttings box being configured to receive the solids from the solids separator. The system may further contain a fluid tank connected to the second exit of the solids separator, with the fluid tank configured to receive and reclaim the remainder of the well bore stream. In the preferred embodiment, the solids separator comprises a centrifuge. A method of removing sand from a well bore and reclaiming a well bore fluid is also disclosed.

17 Claims, 3 Drawing Sheets

SYSTEM FOR REMOVING SOLIDS FROM A WELL BORE

BACKGROUND OF THE INVENTION

This invention relates to a system for removing solids from a well bore and reclaiming the well bore fluid. More particularly, but not by way of limitation, this invention relates to a system and method for removing solids from an oil and gas well bore utilizing a work string, and thereafter, reclaiming the well bore fluid.

In the oil and gas industry, a well is drilled and completed to a hydrocarbon bearing zone from which hydrocarbons are produced. During the life of the well, sand is many times produced from the reservoirs. The sand can build up within the well bore as is well understood by those of ordinary skill in the art.

Operators have found it necessary to remove the sand, debris and other solids that accumulates within the well bore. The sand can cause numerous operational problems, some of which may result in hazardous and/or dangerous conditions. Hence, the sand, debris and other solids require removal.

In the past, operators have run a work string within the well bore in order to wash out the sand and debris. Work strings include coiled tubing, snubbing pipe, drill strings, and other tubulars. One of the problems faced by such an operation includes contamination of the well bore fluid with the sand, debris and other solids. After completion of the wash operation, the well bore fluid has to be separated.

Well bore fluids have become quite sophisticated over the years. As those of ordinary skill in the art will recognize, compatible well bore fluids must be placed into the wells in order to enhance production, decrease corrosion and increase reservoir life. The well bore fluids can become quite costly, and therefore, conservation of the fluids is advantageous. Examples of well bore fluids include, but certainly not limited to, brine, zinc chloride, barite, etc.

The prior art systems of separating, cleaning, and/or reclaiming the well bore fluids have proved to be costly and inefficient. For instance, sock filters have been utilized to filter out the solids. However, the filters become clogged quickly. Further, it is a time consuming practice to exchange dirty filters with clean filters.

Additionally, most of the solid removal operations occur on platforms, semi-ssubmersibles, jack-ups, etc that contain drilling rigs. Therefore, the systems use a cumbersome assembly of shale shakers, settling tanks and charger pumps that are generally associated with drilling systems. These prior art systems take up space, cost significant sums of money and are inefficient.

Presently, the well bore fluid with entrained solids is directed through a shale shaker. Underneath the shale shacker is a settling tank. The well bore fluid is then directed to a centrifuge via a charger pump. Thereafter, the well bore fluid is directed to a main tank. The well bore fluid is then pumped backed into the well bore from this main tank. This is a cumbersome and expense system.

Therefore, there is a need for a system for removing solids from a well bore that takes up a minimum of space and is economical. Further, there is a need for a method of utilizing a work string to clean out sand and debris, and thereafter, reclaim the well bore fluid for further use. There is also a need for a method for reclaiming well bore fluids such as brine when the brine is used to clean out a well bore with a coiled tubing string. These and many other needs will be met by the invention herein disclosed.

SUMMARY OF THE INVENTION

A system for removing solids from a well bore and reclaiming the well bore fluid is disclosed. A work string will be disposed therein. In the preferred embodiment, the well bore will have a coiled tubing string or snubbing pipe concentrically disposed therein. In the most preferred embodiment, the work string is coiled tubing. The system comprises a return line for receiving a well bore stream from the well bore. The well bore stream contains solids, a gas component and a water component.

The system also includes a gas separator means, connected to the return line, for separating the gas component from the remainder of the well bore stream, and wherein the separator means has a first outlet for exiting the gas component and a second outlet for exiting the remainder of the well bore stream. Also included is a solids separator means, connected to the second outlet, for separating the remainder of the well bore stream into a first stream containing the solids and a second stream containing the remainder of the well bore stream, and wherein the solids separator means contains a first exit for exiting the solids and a second exit for exiting the remainder of the stream. The solids separator will be located longitudinally below the gas separator so that a hydrostatic head pressure feeds the well bore fluid to the solids separator.

The system further includes a cuttings box connected to the first exit of the solids separator, with the cuttings box being configured to receive the solids from the solids separator means. The system may further contain a fluid tank connected to the second exit of the solids separator, with the fluid tank configured to receive the remainder of the well bore stream. In the preferred embodiment, measuring means, operatively associated with the cuttings box, for measuring the quantity of solids disposed within the cuttings box will also be included.

In one of the embodiments disclosed, the solids separator means comprises a centrifuge separator. Additionally, the gas separator means comprises a two phase separator. In the preferred embodiment, the well bore fluid is a brine.

A method of removing sand from a well bore and reclaiming a well bore fluid is also disclosed. The well bore will intersect a hydrocarbon reservoir. The method comprises placing a coiled tubing string concentrically within the well bore, with the coiled tubing string forming an annulus therein. A fluid is circulated down the inner bore of the coiled tubing string; fluid exits the end of the coiled tubing string and the sand and debris entrains with the fluid. Additionally, gas from the hydrocarbon bearing reservoir may also entrain with the fluid. The fluid, along with the entrained sand, and entrained gas component mix with the well bore fluid. An oil component from the reservoir may also mix with the fluid. The pumping rate will provide for a back pressure on the return line.

The method further includes circulating the well bore fluid up the well bore annulus and then flowing the well bore fluid into a gas separator under pressure where the gas component is separated from the well bore fluid. Next, the solids are separated from the well bore fluid and the solids are collected in a collection tank. The method may further include measuring the solids in the collection tank and calculating the amount of sand removed from the well bore.

The step of separating the gas component may consist of flowing the well bore fluid to a two-phase separator, dividing the gas component from the well bore fluid, and flowing the well bore fluid to the separator means. In this step, the separator means is located longitudinally below the two-phase separator so that a hydrostatic head pressure is created and aids in flowing the well bore fluid to the separator means.

In the step of separating the solids, the method may include channeling the well bore fluid to a centrifuge separator where the solids are segregated from the well bore fluid. The method may further include recirculating the well bore fluid into the bore of the coiled tubing string. In yet another embodiment, the method may include a step of separating an oil component from the well bore fluid, and thereafter, recirculating the fluid in the well bore.

The fluid used in the well bore may be a variety of different fluids. In the preferred embodiment, the fluid consist of a brine based system. Other fluid systems include zinc chloride, barite based drilling fluid, seawater, etc.

An advantage of the present system includes the ability to reclaim the well bore fluid. Another advantage is that the solids removed from the well bore can be placed in a cuttings box for storage and removal. Yet another advantage is that the amount of solids removed from the well bore may be calculated.

Another advantage is that the system and method disclosed will save time in the separation of unwanted materials. Still yet another advantage is that the present system reclaims the fluid without the need for settling tanks, filters, or other inaccurate methods of measuring and separating solids coming out of wells. The system saves space due to a reduction in the amount of pumps, tanks and equipment needed. Yet another advantage is that the system may be used in open holes, cased holes, liners, deviated wells, horizontal wells, etc.

A feature of the present invention includes use of a gas separator that can separate gas from the fluid. Another feature is use of a solids separator that allows the segregation of solids, such as sand and debris, from the fluid. Still yet another feature is the ability to recirculate the cleaned fluid for further use in the well bore.

In prior art systems, it is necessary to have a charger pump force feed the centrifuge separator. In order to operate, many centrifuges require 25 psi to 50 psi feed with a charger pump. This invention eliminates the need to have this charger pump which saves equipment space, time and money. This novel system uses the pressure created from the well bore fluid circulation as well as the hydrostatic head pressure created from the centrifuge being located underneath the gas separator in order to provide the centrifuge with the necessary pressure feed. Therefore, the system provides the centrifuge with the necessary pressure feed.

Another feature is that the system may filter returns to the 3 to 5 micron range. Further, the calculation of quantity of removed solids is greatly improved over prior art systems in that the calculation is faster and more accurate.

DETAILED DESCRIPTION OF THE PREFERRED EMBODIMENTS

Figure 1A:
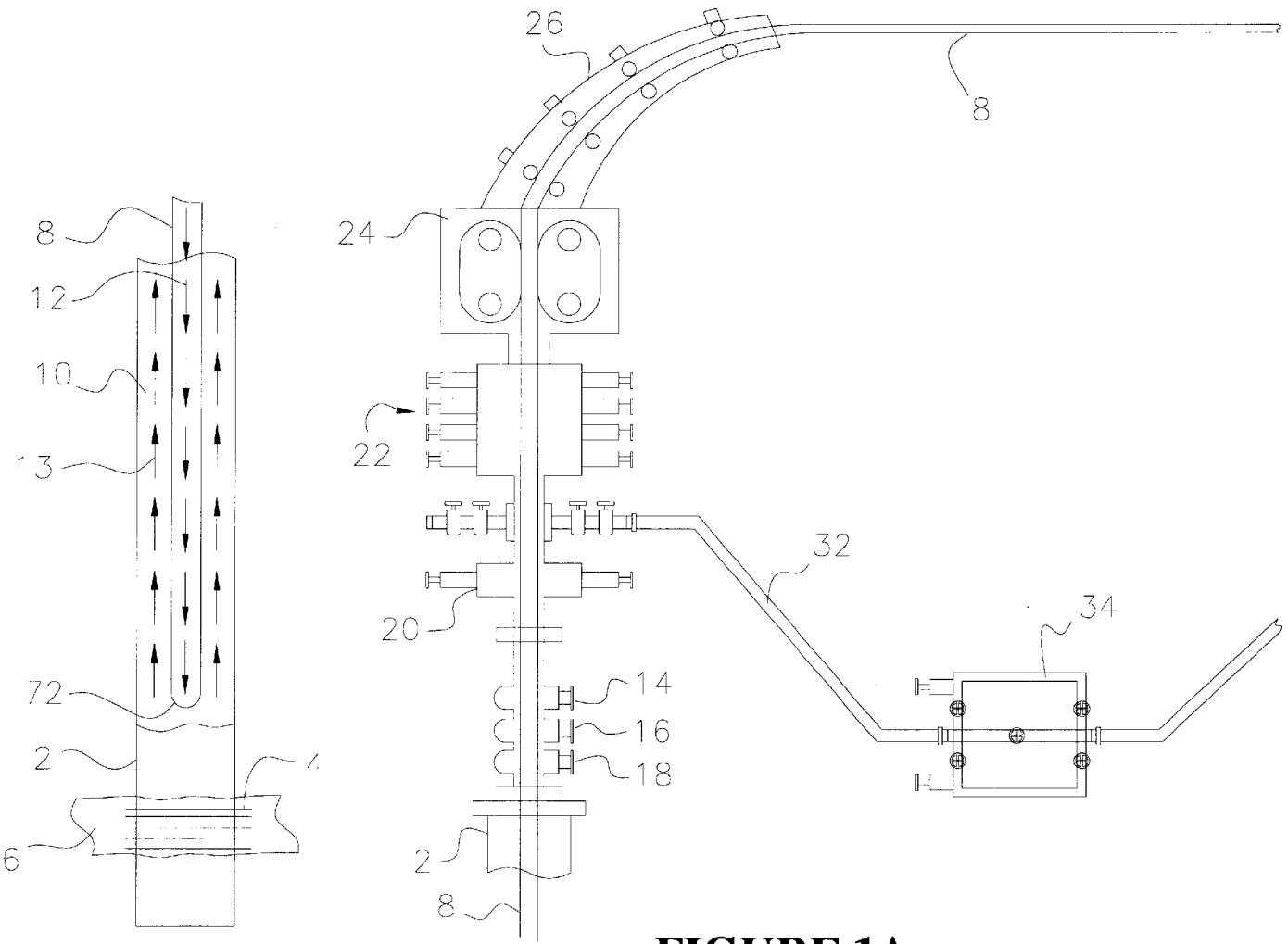
FIGS. 1A and 1B are a perspective view of the system of the present invention.
Figure 1B:
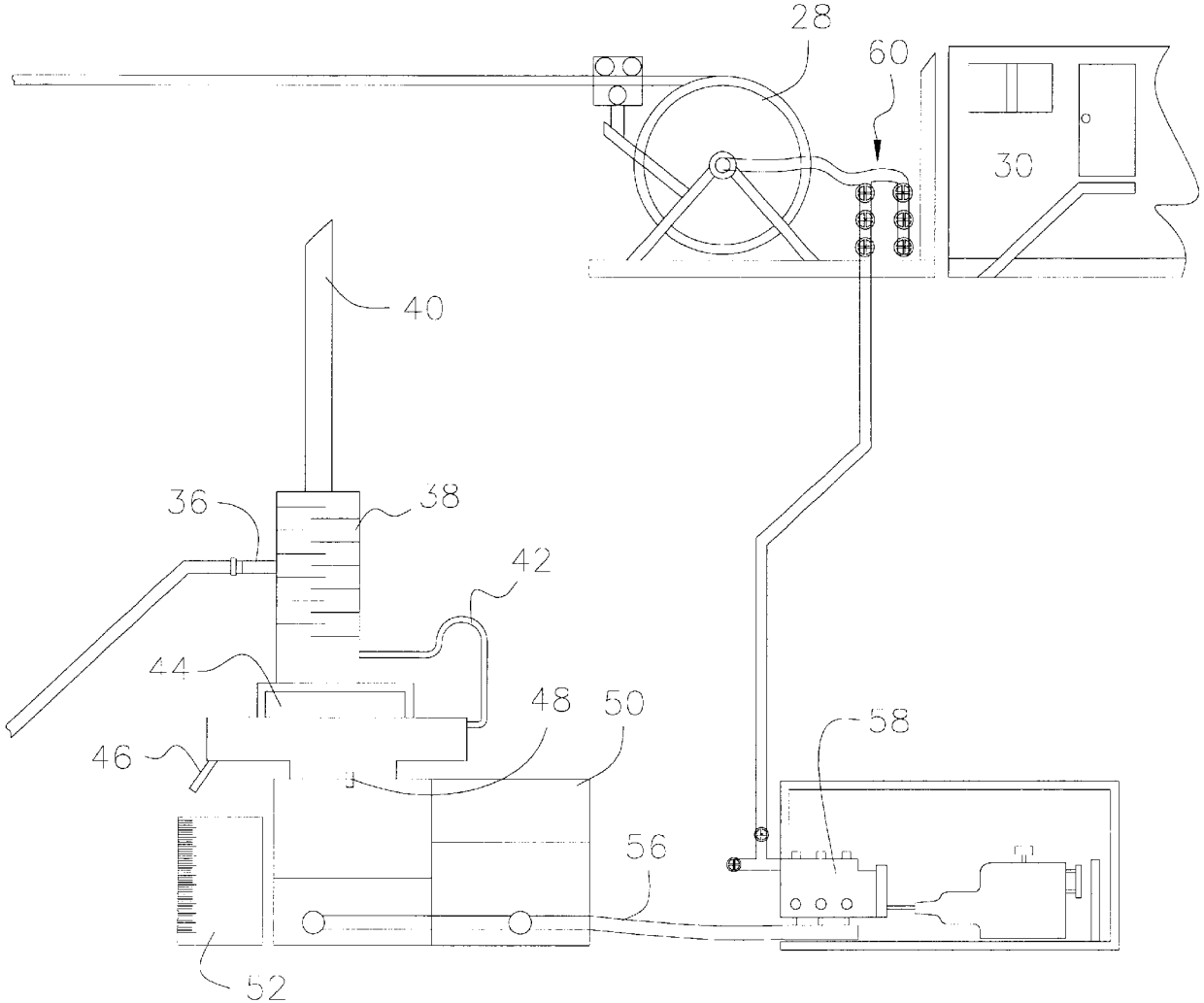

Referring now to FIG. 1, a perspective view of the preferred embodiment of the novel system will now be described. A well bore 2 is included, with the well bore 2 being a cased hole tubular member that has been perforated 4 to a hydrocarbon bearing zone 6. During the course of drilling, completion, and/or production, sand and/or debris may enter the well bore. The sand and/or debris will have to be cleaned out of the well bore, as is well under stood by those of ordinary skill in the art. While a cased hole has been illustrated, the invention is also applicable to open hole.

In the preferred embodiment, the operator will lower a coiled tubing string 8 into the well bore 2. The concentrically placed coiled tubing string 8 has an inner bore, and wherein an annular space 10 is formed. The operator normally pumps a fluid down the coiled tubing bore and up into the annulus 10 as shown by the arrow 12 (down the inner bore of coiled tubing 8) and the arrow 13 (up the annular portion of the well bore). It should be noted that other work strings may be used such as a hydraulic work over string which is referred to by those of ordinary skill in the art as snubbing pipe. In the most preferred embodiment, coiled tubing is utilized.

At the surface, a well head valve system is provided that includes a crown valve 14, swab valve 16, and master valve 18. A series of blow out preventor valves are also shown, which include rams 20 and rams 22. An injector head 24 is connected to the BOP stack 22 which in turn extends to a goose neck member 26. As shown in FIG. 1, the coiled tubing string 8 extends through these surface safety devices as is well understood by those of ordinary skill in the art. The coiled tubing string 8 extends to the pipe reel 28 where the excess string 8 is stored. The control console 30 is also depicted.

FIG. 1 also depicts the return line 32 that is connected to the well bore annulus 10. This line 32 channels the fluid from the annulus 10 to the choke manifold 34. The choke manifold 34 is a series of valves for regulating the flow direction of the contents within the return line 32. In accordance with the teachings of the present invention, the return line 32 continues from the choke manifold 34 to the inlet 36 of the gas separator 38. The gas separator 38 may be a two-phase separator for separating the gas component of the fluid stream from the remainder of the stream. An example of an acceptable gas separator 38 is one that is commercially available from Supreme Rentals, Inc. under the name Gas Busters. In the embodiment shown, the gas separator 38 will have a gas outlet 40 for allowing the gas phase to escape into the atmosphere.

The remainder of the fluid stream will then be directed via the line 42 to the solids separator means denoted by the numeral 44. In the preferred embodiment, the solids separator means 44 is a centrifuge separator 44 that is commercially available from Brandt Industries, Inc. under the name Centrifuge Separator. The centrifuge separator 44 will generally comprise a compartment with a rotatable mandrel disposed therein, with the rotating center mandrel separating the incoming well bore stream into a first higher density stream containing the solids and a second stream containing the remainder of the well bore stream due to the centrifugal forces, as is well known in the art. The centrifuge separator 44 contains a first exit line 46 for exiting the solids that have been separated from the fluid stream and a second exit line 48? for exiting the remainder of the well bore stream.

The second exit line 48 will channel the fluid stream to a collection vessel 50. The collection vessel 50 can be used for further gravity separation if required. The first exit line 46 leads to a collection box 52 which will collect the solids. As noted on the box 52, increment level markings 54 are included on the sides for measuring the amount of solids that have been removed from the well bore. Each increment represents a specific volume within the collection box 52. It should be noted that other types of measuring means are available such as level measuring devices.

The collection vessel 50 will have an exit line 56 that will lead to the pump means 58 for pumping the fluid to the pump manifold 60 located on the pipe reel 28 which in turn will fluidly connect with the coiled tubing string 8. A typical pump means is commercially available from Supreme Rentals, Inc. under the name 5000# Fluid Pump. Hence, the circulation of the fluid may proceed, as will be more fully explained.

Figure 2:
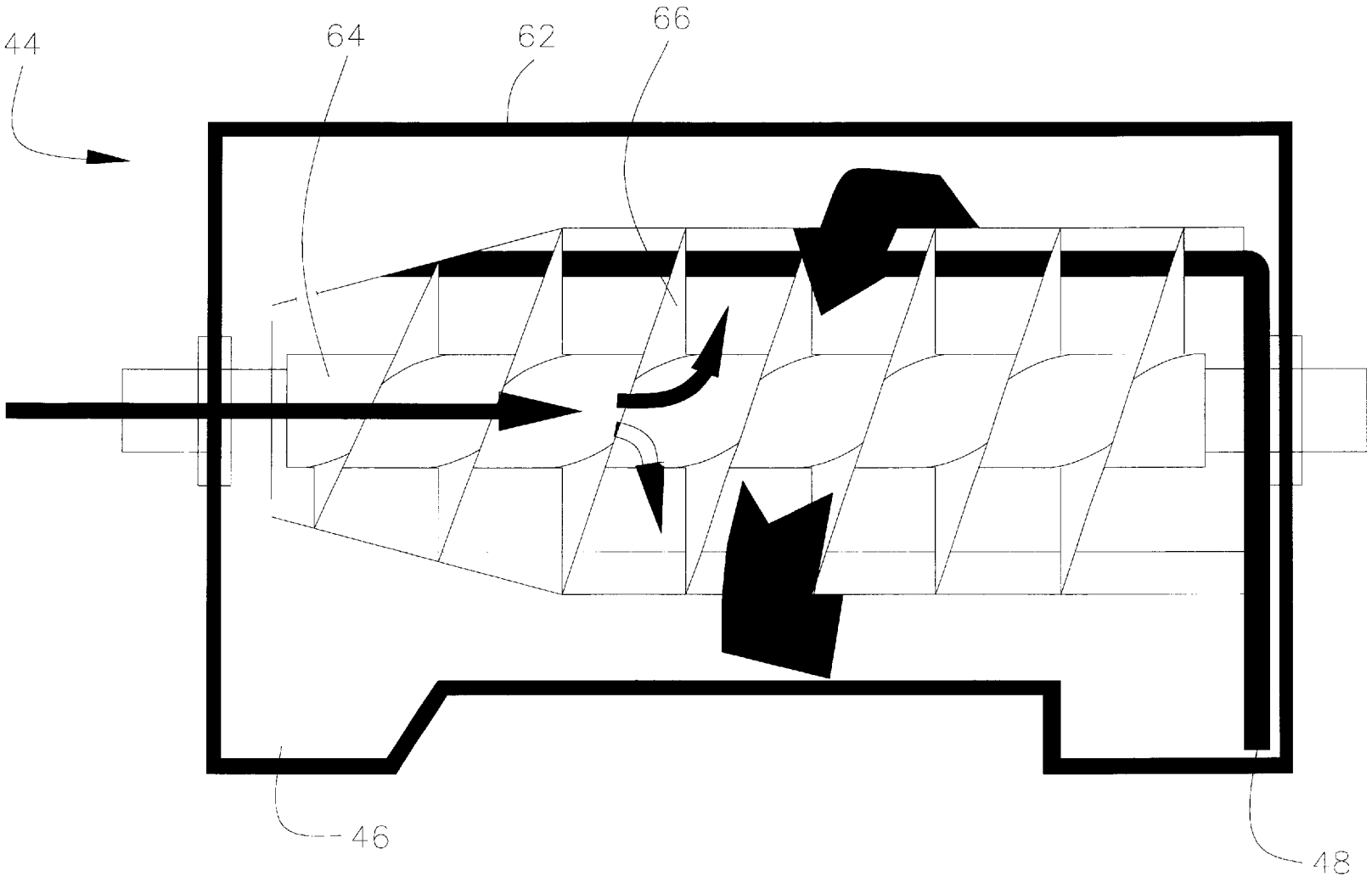
FIG. 2 is a cross-sectional view of the centrifuge separator.

Referring now to FIG. 2, a cross-sectional view of the centrifuge separator 44 is shown. The separator 44 includes a container 62, with the container 62 having a rotatable center mandrel 64. The mandrel 64 will further have a spiral blade 66 thereon so that the an internal auger is formed. The arrow 67 denotes the incoming fluid stream. As is understood by those of ordinary skill in the art, the rotating mandrel 64 will force the solids radially outwards to the solids exit 46 while the fluid will travel downward about the mandrel to the fluid exit 48. In other words, the rotating the center mandrel 64 within the centrifuge separator means causing a centrifugal force to direct the solids to the inner wall 68 and ultimately to the solids exit 46 as is well understood by those of ordinary skill in the art.

In the operation of circulating the well bore with fluid, the operator will pump the fluid down the inner bore of the coiled tubing string 8 while the coiled tubing string 8 is concentrically disposed within the well bore 2. The path of the fluid down the inner bore is denoted by the arrow 12. The fluid will exit the end 72 of the coiled tubing 8, which end 62 may be a wash nozzle type of device. The fluid jetting out of the end 72 will entrain the sand, debris and other solids within the well bore 2. The fluid with entrained sand, debris, and solids will travel up the annulus 10. The fluid will exit the annulus via the return line 32. This well bore fluid will then be directed to the choke manifold 34 and ultimately to the gas separator 38 where any entrained gas which may have entered the well bore fluid from the reservoir 6 can be segregated from the well bore fluid.

The well bore fluid (minus the gas component) will be directed downward to the solids separator 44 via line 42. The centrifugal force of the separator will act to segregate the fluid from the sand, solids and debris. The sand, solids and other debris will be channeled to the collections box 52 via line 46. The well bore fluid, which has now been filtered to a filter range of 3 to 5 microns by way of this novel method, can be collected in the collection vessel 50. Thereafter, the fluid can be recirculated into the well bore 2 as previously described. In this way, the fluid has been reclaimed and the process of circulation, separation, and filtration continuously proceeds.

In prior art systems, it is necessary to have a charger pump force feed the centrifuge separator. Many centrifuges require 25 psi to 50 psi feed with a charger pump. This invention eliminates the need to have this charger pump which saves equipment space, time and money. The system herein disclosed uses a work string (generally coiled tubing) having a diameter of 1 ¼" to 1½" with pump circulation rates that generally do not exceed 1 barrel per minute. The novel system and method provides for the gas separator 38 liquid output to feed the centrifuge 44, with centrifuge 44 being longitudinally below the gas separator 38 so that a hydrostatic head feeding the centrifuge 44 is created. This hydrostatic head aids in creating a proper pressure feed into the centrifuge 44.

Examples of hydrostatic weight calculations in light of this novel system follows. It should be noted that the well bore fluids generally range from 8.6 pounds per gallon for sea water to 9.5 pounds for calcium chloride. Sea water will be used with the following example calculations. At a ¼ barrel per minute circulation rate and pulling out of the well (which is in the normal range), the hydrostatic weight is 90.3 pounds/minute; that calculation is as follows: 10.5 g.p.m. ×8.6 p.p.g. fluid weight =90.3 pounds/min. At ½ barrel per minute circulation rate, the hydrostatic weight is 180 pounds/minute; that calculation is as follows: 21 gpm×8.6 ppg=180 pounds/minute. Therefore, with the use of simple sea water, there is enough hydrostatic weight to supply the centrifuge 44. This is due to the pressure created by the pump circulation rate (by pumping into the well 2 via the coiled tubing string 8) as well as the hydrostatic head created by the centrifuge 44 being located below the gas separator 38.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

I claim:

1. A system for removing solids from a well bore, said well bore having a coiled tubing string concentrically disposed therein, said system comprising:

a return line for receiving a well bore stream from said well bore, and wherein said well bore stream contains the solids, and an oil component, a gas component and a water component;

a gas separator means, connected to said return line, for separating the gas component from the solids, oil component, and water component of the well bore stream, and wherein said separator means has a first outlet for exiting the gas component and a second outlet for exiting the solids, oil component, and water component of the well bore stream;

a solids separator means, connected to said second outlet, for separating the solids, oil component, and water component of the well bore stream into a first stream containing the solids and a second stream containing the solids, oil component, and water component of the well bore stream, and wherein said solids separator means contains a first exit for exiting the solids and a second exit for exiting the solids, oil component, and water component of the stream;

a cuttings box connected to said first exit of said solids separator, said cuttings box configured to receive the solids from said solids separator means.

2. The system of claim 1 further comprising:

a fluid tank connected to said second exit of said solids separator, said fluid tank configured to receive the solids, oil component, and water component of the well bore stream.

3. The system of claim 2 further comprising:

means, operatively associated with said cuttings box, for measuring the quantity of solids disposed within said cuttings box.

4. The system of claim 3 wherein said solids separator means comprises a centrifuge separator and wherein said centrifuge separator is located longitudinally below said gas separator means so that a hydrostatic head pressure feeds the well bore stream to said centrifuge separator.

5. The system of claim 4 wherein said gas separator means comprises a two phase separator and wherein said two phase separator contains an outlet for discharge of the gas component into the atmosphere.

6. The system of claim 5 wherein said water component of the well bore stream is a brine.

7. A method of removing sand from a well bore and reclaiming a well bore fluid, said well bore intersecting a hydrocarbon reservoir, the method comprising:

placing a coiled tubing string concentrically within the well bore, said coiled tubing string having an inner bore therethrough, and wherein said coiled tubing string forms an annulus with said well bore;

circulating a fluid down the inner bore of said coiled tubing string under a pressure;

entraining the fluid with the sand;

entraining a gas component from the hydrocarbon reservoir with the fluid, and wherein the fluid, entrained sand, and entrained gas component mixes with the fluid so that the well bore fluid is formed;

lifting the well bore fluid up the well bore annulus;

flowing the well bore fluid into a gas separator under the pressure;

separating the gas component from the well bore fluid;

separating the sand from the well bore fluid;

collecting the sand in a collection tank;

reclaiming the fluid within a fluid tank.

8. The method of claim 7 further comprising:

measuring the solids in the collection tank;

calculating the amount of sand removed from the well bore.

9. The method of claim 8 wherein the step of separating the gas component comprises:

flowing the well bore fluid to a two-phase separator;

dividing the gas component from the well bore fluid;

flowing the well bore fluid to a centrifuge separator means and wherein the centrifuge separator means is located longitudinally below the two-phase separator so that a hydrostatic head pressure is created and wherein the hydrostatic head pressure aids in flowing the well bore fluid to the centrifuge separator means.

10. The method of claim 9 wherein the step of separating the solids comprises:

channeling the well bore fluid to the centrifuge separator means, said centrifuge separator comprising a cylindrical housing having an inner portion, a center mandrel disposed within the inner portion of the cylindrical housing, and wherein said cylindrical housing contains an inner wall;

rotating the center mandrel within said centrifuge separator means causing a centrifugal force to direct the solids to said inner wall;

segregating the solids from the well bore fluid.

11. The method of claim 10 wherein the well bore fluid contains an oil component and the method further comprising:

separating the oil component from the well bore fluid so that the well bore fluid no longer contains the oil component or the gas component;

recirculating the well bore fluid back into the inner bore of the coiled tubing string.

12. The method of claim 11 wherein the step of circulating the fluid down the inner bore of said coiled tubing string under pressure includes circulating the fluid at a rate of at least one-quarter barrel per minute so that a back pressure is created on a return line connected to the gas separator and wherein the back pressure is communicated to the gas separator.

13. The method of claim 12 wherein the fluid comprises a brine.

14. The method of claim 12 wherein the fluid comprises a sea water having a weight of at least 8.6 pounds per gallon.

15. A system for reclaiming a brine fluid from an oil and gas well bore, the system comprising:

a work string concentrically disposed within the well bore, said work string creating an annulus within the well bore;

a return line connected to the annulus for receiving a well bore stream from said well bore, and wherein said well bore stream contains solids, and an oil component, a gas component and a water component;

a two phase separator having an inlet receiving the well bore fluid stream from said return line, said two phase separator having a top end being connected to a gas outlet line and said bottom end having a well bore fluid outlet line, and wherein said gas outlet line discharges the gas component of the well bore fluid;

a centrifuge separator, connected to said well bore fluid outlet line, said centrifuge separator comprising a compartment having a rotating center mandrel disposed therein for separating the solids, oil component, gas component and the water component of the well bore stream into a first higher density stream containing the solids and a second stream containing the oil component, gas component and the water component of the well bore stream, and wherein said centrifuge separator contains a first exit for exiting the solids and a second exit for exiting the oil component, gas component and the water component of the well bore stream, and wherein said centrifuge separator is located longitudinally below the two phase separator creating a hydrostatic head pressure and wherein said hydrostatic head pressure feeds the well bore fluid to the centrifuge separator;

a container connected to said first exit of said centrifuge separator, said container configured to receive the solids from said centrifuge separator;

a fluid tank connected to said second exit of said centrifuge separator, said fluid tank configured to receive the oil component, gas component and the water component of the well bore stream, and wherein the water component of the well bore stream is substantially brine.

16. The system of claim 15 wherein said work string comprises a coiled tubing string.

17. The system of claim 16 further comprising:

means, operatively associated with said container, for measuring the quantity of solids disposed within said container.

* * * * *